US005342655A

United States Patent [19]

Roller et al.

[11] Patent Number: 5,342,655

[45] Date of Patent: Aug. 30, 1994

[54] SOLID FILM LUBRICANT

[75] Inventors: Kent G. Roller, Boulder; Bradley A. Scott, Louisville; Timothy C. LeBlanc, Niwot, all of Colo.

[73] Assignee: Ball Corporation, Ind.

[21] Appl. No.: 18,726

[22] Filed: Feb. 17, 1993

[51] Int. Cl.[5] ..... B05D 3/02; B05D 1/00; C10M 105/76; F01M 1/00

[52] U.S. Cl. ..... 427/372.2; 427/385.5; 427/401; 427/407.1; 427/419.7; 252/9; 184/109

[58] Field of Search ..... 427/372.2, 385.5, 401, 427/407.1, 419.7; 252/9; 184/109

[56] References Cited

U.S. PATENT DOCUMENTS 3,014,865 12/1961 Seniff et al. ..... 252/12
3,674,690 7/1972 Clow et al. ..... 252/25
3,778,308 12/1973 Roller et al. ..... 117/234
3,862,860 1/1975 Pardee et al. ..... 117/239
4,202,780 5/1980 Brendle ..... 252/12
4,338,376 7/1982 Kritzler ..... 428/417
4,474,669 10/1984 Lewis et al. ..... 252/23
4,828,729 5/1989 Centers ..... 252/25
4,892,669 1/1990 Marcora et al. ..... 252/30

*Primary Examiner*—Anthony McFarlane
*Assistant Examiner*—Nhat D. Phan
*Attorney, Agent, or Firm*—Gilbert E. Alberding

[57] ABSTRACT

A solid film lubricant having a certain degree of flexibility when cured to, for instance, enhance the wear life of the lubricant. In one embodiment, a composition of such a lubricant includes a dichalcogenide such as molybdenum disulfide and a chlorotrifluoroethylene-vinyl chloride copolymer binder. In addition, a silane curing agent may be utilized to react with the binder to improve the properties and/or performance characteristics of the lubricant.

14 Claims, 1 Drawing Sheet

SOLID FILM LUBRICANT

FIELD OF THE INVENTION

The present invention generally relates to the field of lubrication and, more particularly, to solid film lubricants.

BACKGROUND OF THE INVENTION

Solid lubricants typically comprise a relatively thin film of at least one solid which is applied to one or more moving, interfacing surfaces. Although lubricants in general function to reduce friction and/or wear between such surfaces, solid film lubricants have been used in a wide variety of applications requiring additional performance characteristics. U.S. Pat. Nos. 3,014,865; 3,674,690; 3,778,308; 3,862,860; 4,202,780; 4,338,376; 4,474,669; 4,828,729; and 4,892,669 are generally representative of various applications for lubricants.

One application for solid film lubricants is to provide lubrication between load-bearing surfaces such as in gears, bearings, and between sliding metal plates. In each of these types of applications, a significant load may be communicated through the solid film lubricant. Therefore, it is desirable not only for the solid film lubricant to provide for a combination of friction and wear reduction between the interfacing surfaces, but also for the lubricant to adequately perform these functions under load conditions for an extended period of time. That is, the wear life of the lubricant is also an important factor in evaluating the lubricant's overall performance.

There are generally two basic types of solid lubricants. Unbonded solid lubricants (e.g., in the form of a powder), are typically directly applied to a surface to be lubricated and adhere thereto by some degree of mechanical or molecular action (i.e., the lubricant is not physically or chemically bonded to the surface being lubricated). Consequently, the properties of the solids themselves will generally define the performance characteristics for the given application. However, since there is no physical or chemical bonding of the solid lubricant to the surface, the potential exists, particularly in load-bearing applications, that the unbonded solid lubricant will not remain in position to provide the desired performance over an extended period of time.

An alternative solid lubricant to the above is a bonded solid lubricant. These lubricants are physically or chemically attached to the desired surface by an adhesive or binder. Generally, the solid lubricant is mixed with the particular adhesive/binder and applied to one or more of the surfaces to provide a film of a desired thickness. Depending upon the application, proper selection of the adhesive/binder may be important.

One consideration in adhesive/binder selection is the manner in which the adhesive/binder is cured. For instance, some adhesives/binders require thermal curing at relatively high temperatures for significant periods of time. Consequently, this typically requires that the part being lubricated be positioned in a curing oven after application of the lubricant thereto. Although this may be acceptable in certain applications, it may not be in the case where relatively large components are involved and/or when removal of the part to be lubricated is cumbersome. As a result of these types of disadvantages, air curable adhesives/binders have been used in certain applications. In this case, lubrication may often take place in situ and after an appropriate cure time at room temperature the solid film lubricant will be ready for use.

Another consideration in adhesive/binder selection is the manner in which the cured solid film lubricant may be removed. For instance, in many cases the initial application of the solid film lubricant is not satisfactory such that the lubricant must be removed and reapplied. Many adhesives/binders used with solid lubricants are non-soluble such that they must be physically ground or mechanically removed from the lubricated surface(s) (e.g., when an epoxy is used). As can be appreciated, this greatly affects lubrication procedures and expenses. Moreover, in the event that a thermally curable adhesive/binder is being utilized, this further increases lubrication costs since once again the lubricated part is typically placed in an oven for an extended period of time (e.g., 56 hours at 300° C. in the case of a solid lubricant which includes molybdenum disulfide, antimony trioxide and a polyimide binder).

The binder not only impacts application and removal requirements, but may also affect the performance characteristics of the solid film lubricant. For instance, in the case of load-bearing applications it has been generally accepted theory that the binder be selected and the lubricant applied such that the cured solid lubricant film will be as thin and hard as possible. Consequently, the lubricant effectively communicates the load and does not itself carry any of the load. One problem associated with this particular theory is that the wear life of the lubricant is adversely affected and unacceptable in certain applications. More particularly, the surface of the cured solid film lubricant has a certain roughness and is defined by a series of asperities (i.e., tiny peaks) with cavities interspersed therebetween. These asperities often interlock with the cavities on the interfacing surface. Consequently, when there is relative motion between these surfaces, over time, if not initially, there is a tendency for the asperities to break off. This affects the performance of the lubricant and ultimately its own wear life.

Based upon the foregoing, it should be appreciated that binder selection is an important aspect relating to bonded solid film lubricants for particular applications. Not only does the binder effectively dictate the lubrication application/removal characteristics of the solid film lubricant, but it also impacts the performance characteristics of the lubricant as well.

SUMMARY OF THE INVENTION

The present invention relates to a bonded solid film lubricant in which the selected binder provides certain desirable characteristics, including cases where the lubricant is used in load-bearing applications between moving, interfacing, substantially rigid surfaces.

In one aspect, a novel lubricant is disclosed which includes a dichalcogenide as the primary lubricant (e.g., molybdenum disulfide), together with antimony trioxide to modify the tribological characteristics of the lubricant if desired, and a chlorotrifluoroethylene-vinyl chloride copolymer binder. This particular binder is air curable at ambient temperature over an acceptable period of time. Consequently, the lubricant may be applied to a given part without requiring the removal and placement of such in a curing oven for an extended period of time. Moreover, this particular binder is solvent soluble such that the costs associated with removal and reapplication of the lubrication are minimized. In order to further enhance the properties/performance characteristics of the above-noted lubricant, a silane (e.g., an amino silane such as N-2-aminoethyl-3-aminopropyltrimethoxy silane) may be incorporated into the composition and such is believed to actually react in some manner with the binder to alter its physical/chemical nature/properties (e.g., to improve surface adhesion of the lubricant). Consequently, the silane can effectively be categorized as a curing agent.

In another aspect of the present invention, the binder is selected to have a certain degree of flexibility when cured (e.g., rubbery), versus the degree of hardness indicative of existing dry solid film lubrication theory. When an appropriate solid is incorporated with the binder and such is applied to and cured on a given surface which movably interfaces with another surface, the surface of the lubricant film is defined by a series of asperities and cavities therebetween. The asperities of the lubricant film interact/interlock with the cavities on the interfacing surface (which may also be lubricated with the above solid film lubricant). Due to the flexibility of the selected binder (e.g., a chlorotrifluoroethylene-vinyl chloride copolymer binder), the relative motion between the interfacing surfaces will cause the asperities of the lubricant film(s) to bend versus attempt to maintain a substantially vertical orientation as commonly associated with "hard" binders. As a result, the wear life of the lubricant of the present invention is enhanced over those solid lubricants which utilize a "hard" binder. Moreover, in the event that an appropriate solid is incorporated (e.g., the above-noted molybdenum disulfide or other dichalcogenides together with antimony trioxide if desired), the performance of the lubricant of the present invention in load-bearing applications is enhanced in that the solid(s) will carry some of the load versus merely communicating the load to the other interfacing surface.

DETAILED DESCRIPTION

Figure 1B:
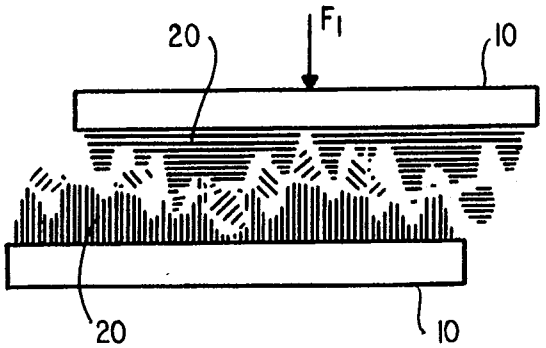
FIG. 1b PRIOR ART
FIG. 1*b* is a cross-sectional view of the lubricant of FIG. 1*a* when there is relative sliding motion between the surfaces and illustrating the effect of such on the asperities.

The present invention will be described with reference to the accompanying drawings which assist in illustrating the pertinent features thereof. In this regard, the present invention relates to a solid film lubricant having a binder which enhances one or more performance and/or other characteristics of the solid film lubricant, particularly in load-bearing applications (e.g., when lubricating gears, bearings, sliding plates).

One composition of a solid film lubricant in accordance with the principles of the present invention includes a dichalcogenide and a chlorotrifluoroethylene-vinyl chloride copolymer binder. Although all dichalcogenides are appropriate for use in the dry solid film lubricant in most applications, molybdenum disulfide is generally preferred due primarily to the consistency of its properties as well as its load-carrying capabilities. More particularly, molybdenum disulfide is naturally occurring and thus its physical properties are relatively consistent compared to dichalcogenides which are synthetically formed (i.e., synthetic dichalcogenides will not typically have the same properties from batch to batch). When molybdenum disulfide is utilized, additional constituents such as antimony trioxide may be incorporated to affect the overall properties/performance characteristics (e.g., tribological) of the lubricant. Regardless of the type of dichalcogenide or other solid(s) utilized, the size of such, particularly in load-bearing applications, may be selected to match the surface roughness of the surface to be lubricated. More particularly, and as an example, when molybdenum disulfide is incorporated into the lubricant composition for a load-bearing application, the particle size selected for the molybdenum disulfide is about 0.5 microns such that the individual particles adequately "seat" within the cavities defining the surface roughness of the substrate for a substrate surface roughness of up to about 20 microinch (RMS). Larger particles of molybdenum disulfide are used for a substrate surface roughness greater than about 20 microinch (RMS).

The above-identified composition also includes a chlorotrifluoroethylene-vinyl chloride copolymer binder (Oxy 461 available from Occidental Petroleum) which adheres the solid film lubricant to the desired surface. This particular binder provides a number of advantages. For instance, the binder is curable at room temperature (e.g., approximately 20 to 24 hours at approximately 65° F. to 75° F.). This alleviates the requirement for removal of the part being lubricated and the positioning of such in a curing oven for an extended period of time. In certain instances, this will also allow for lubrication of a given component part in situ. Although in many applications this room temperature cure will prove desirable, in other instances it may not be required. Therefore, the binder may also be thermally cured and have relatively the same performance characteristics by curing the binder for approximately 1 hour at a slightly elevated temperature (approximately 100° C.).

Another important aspect of the chlorotrifluoroethylene-vinyl chloride copolymer binder relates to its solubility. In this regard, the chlorotrifluoroethylene-vinyl chloride copolymer binder is very solvent soluble with solvents such as xylene, toluene, chlorinated hydrocarbons, ketones, and has limited solubility in alcohols and aliphatic hydrocarbons. When the above-identified binder is utilized, removal merely requires the use of the above-identified solvents to remove the lubricant from the surface, versus a grinding or physical removal associated with many existing solid film lubricants. As can be appreciated, the use of the above-identified air-curable chlorotrifluoroethylene-vinyl chloride copolymer binder is further advantageous in that the part does not have to be removed and positioned in an oven for an extended period of time after reapplication of the lubricant film.

Another property of the chlorotrifluoroethylene-vinyl chloride copolymer binder is the degree of flexibility it retains even after curing. As noted above, existing solid film lubricant theory is to make the lubricant as hard and thin as possible. The present invention deviates from this theory in that a binder is selected which has a degree of flexibility after curing which enhances the wear life of the lubricant as will be discussed in more detail with regard to FIGS. 2*a*–2*b* below. Moreover, the thickness of the film of dry solid film lubricant in accordance with the principles of the present invention may range from about 0.0002 inches to about 0.0004 inches.

Although the above-identified constituents, namely the dichalcogenide (or other appropriate solids and depending upon the application) and chlorotrifluorethylene-vinyl chloride copolymer binder are the primary constituents and provide desirable properties and/or performance characteristics, one additional constituent appears to further enhance the properties and/or performance characteristics of the solid film lubricant associated with the present invention. This constituent is a silane which is believed to function as a curing agent in contrast to previous uses of silanes as adhesion promoters in which case the silane was effectively used only as a surface primer. Although all silanes may not perform the desired function(s) to the desired degree for purposes of the present invention, one which does is an amino silane such as N-2-aminoethyl-3-aminopropyltrimethoxy silane. This particular silane is believed to actually react in some manner with the above-identified binder to change its physical and/or functional characteristics such that the silane is effectively a curing agent for the binder. Moreover, this particular silane may also accelerate the curing time for the solid film lubricant. Furthermore, it is believed that this particular silane may contribute to the lubricity of the lubricant and/or increase the adhesion of such to the particular surface by reaction with the binder. Notwithstanding the curing of the noted binder, even when this particular silane is incorporated, the cured lubricant still remains solvent soluble such that the lubricant may be removed with the above-identified types of solvents.

The above-identified composition may also include various other constituents. For instance, an appropriate wetting agent such as FC-431 (a fluorochlorocarbon wetting agent available from 3M Corporation) may be incorporated into the composition for purposes of enhancing the wetting of the lubricating powders, the miscibility of the liquids, and wetting of the substrate being coated (i.e., the wetting agent enhances the potential for achieving a homogeneous mixture). Moreover, various solvents, including those identified above for removal of the lubricant, may also be incorporated for purposes of diluting the mixture. With regard to preparation of a mixture of the solid film lubricant based upon the principles of the present invention and when all of the above-identified constituents are incorporated therein, typical mixing procedures and apparatus may be utilized. Generally, the silane and binder are introduced into the solvent along with the wetting agent such that the binder is dissolved. Thereafter the molybdenum disulfide and antimony trioxide are mixed into the solution.

As an example of one particular composition of the lubricant in accordance with the present invention, the following parts by weight may be utilized: (1) 0.5 to 5.0 parts of the specifically identified amino silane, preferably 1.5 parts (0.5 micron particle size); (2) 50–200 parts molybdenum disulfide, preferably 132 parts (0.5 micron particle size); (3) 50–200 parts antimony trioxide, preferably 108 parts (reagent grade powder); (4) 30–100 parts of the chlorotrifluoroethylene-vinyl chloride copolymer binder, preferably 45 parts; (5) 0.5 to 5.0 parts FC-431, preferably 1.25 parts; and (6) greater than 300 parts xylene, preferably 700 parts. When the above-identified constituents are all incorporated into the mixture for the lubricant of the present invention, upon application and appropriate curing of such the remaining constituents will primarily comprise the molybdenum disulfide, the antimony trioxide, and the chlorotrifluoroethylene-vinyl chloride copolymer binder. However, small amounts of the silane may remain therein as well, namely that part of the silane which reacts with the binder. Nonetheless, the FC-431 and xylene evaporate out of the mixture after appropriate curing.

With regard to the manner of application of the above-identified lubricant, such may be applied by spray or other appropriate methods such as brushing, dipping, rolling, etc. After appropriate curing (e.g., approximately 24 hours at a temperature of 70° F. if an "air cure" is desired/required, or approximately 1 hour at a temperature of about 100° C. if a thermal cure is desired/required), the lubricant is ready for use (typically in applications where the ambient temperature ranges from about −269° C. to about 200° C.). Although the noted composition may be used by itself on an interfacing surface as the primary lubricant, it may be desirable to place an overcoating of burnished molybdenum disulfide thereon after the application of the lubricant to the surface. This reduces the coefficient of friction for initial contact of the interfacing surfaces and/or improves the wear life of the lubricant to a certain degree. Moreover, the noted composition may include an overcoating of perfluorinated telomer (Vydax 1000 available from E. I. Dupont). This particular overcoating significantly reduces the coefficient of friction and actually gets embedded into the solid film lubricant. This may also enhance the wear life of the lubricant.

Although the dry solid film lubricant incorporating the chlorotrifluoroethylene-vinyl chloride copolyner binder and molybdenum disulfide/antimony trioxide may be used in a variety of applications, it has been found to desirably perform in load-bearing applications (i.e., when the load involved between interfacing components exceeds about a few pounds per square inch). That is, the above-identified lubricant has been found useful as a lubricant for interfacing surfaces in gears, bearing surfaces, and/or sliding plates. This is primarily due to the flexibility remaining in the lubricant upon curing of the defined binder as will be discussed below. In contrast and as noted above, the presently accepted theory is to utilize a solid film lubricant which is as hard and thin as possible.

One prior art composition of a dry solid film lubricant from the "hard and thin" theory incorporates molybdenum disulfide and antimony trioxide lubricating pigments, a polyimide binder, xylene, n-methylpyrrolidinone thinners, and a modiflow wetting agent. This particular binder must be thermally cured at a temperature of approximately 300° C. for a cure time of approximately 56 hours.

Figure 1A:
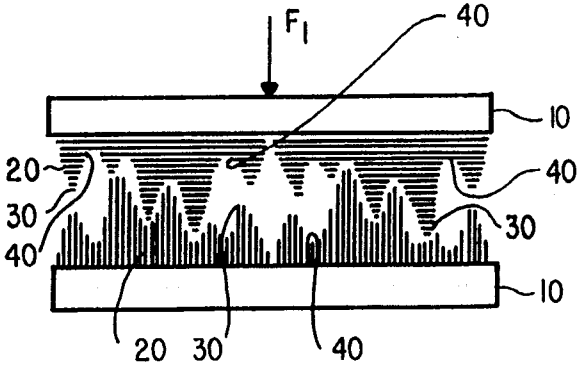
FIG. 1a PRIOR ART
FIG. 1*a* is a cross-sectional view of a prior art dry solid film lubricant applied on two interfacing surfaces.

General representations of the above-identified type of prior art solid film lubricant are illustrated in FIGS. 1*a* and 1*b* in which such has been applied to substantially rigid, metal plates 10 in the above-described manner. In FIG. 1*a*, the plates 10 are stationary relative to each other and a lubricant 20 has been applied to each of such plates 10. The interfacing surfaces of these lubricants 20, as would a bare metal surface, have a certain roughness which may be defined by a series of asperities 30 (i.e., peaks) and cavities 40 interspersed therebetween. Some of the asperities 30 are actually seated within the cavities 40 of the opposing surface. In applications where there is no relative motion, this particular interlocking of various asperities 30 with cavities 40 is not generally significant. However, when relative motion (such as the sliding motion illustrated in FIG. 1*b*) is introduced and particularly when a load $F_1$ is involved (any force having a normal force component and including where such would be a load-bearing application as defined above), the potential exists for the upper portions of the asperities 30 to break off due to the "rigidity" of the lubricant 20. As a result, the lubricant wear life is adversely affected, such that the broken-off asperities in effect act as an abrasionary agent upon continued relative motion. Although this representation of the "hard and thin" theory of solid film lubricants has been discussed with regard to sliding metal plates, it should be appreciated that such is equally applicable to all load-bearing applications such as interfacing gears, balls/races in ball bearings, and the like.

Figure 2B:
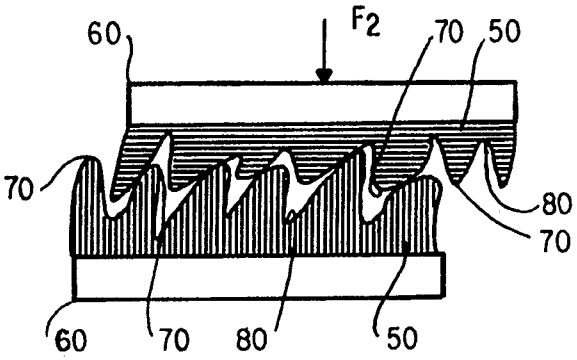
FIG. 2*b* is a cross-sectional view of the lubricant of FIG. 2*a* when there is relative sliding motion between the surfaces and illustrating the effect of such on the asperities.
Figure 2A:
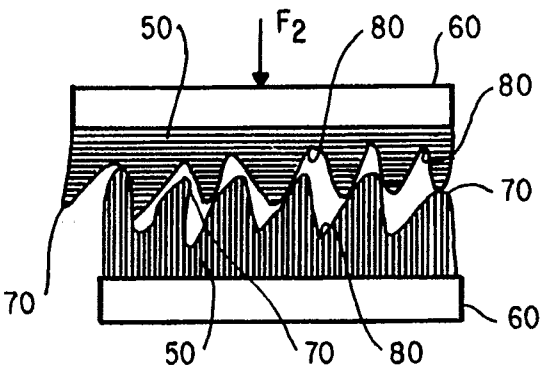
FIG. 2*a* is a cross-sectional view of a dry solid film lubricant of the present invention applied on two interfacing surfaces.

In contrast to the foregoing "hard and thin" solid film lubricant theory, FIGS. 2*a* and 2*b* illustrate a solid film lubricant 50 incorporating the chlorotrifluoroethylene-vinyl chloride copolymer binder and appropriate solid (e.g., molybdenum disulfide and antimony trioxide) in accordance with the principles of the present invention. In this case, the lubricant 50 may be applied to one or both of the substantially rigid, metal plates 60 and cured in the above-described manner. As with the case of the lubricant 20, the surface of the lubricant 50 is defined by a certain roughness. Therefore, a plurality of asperities 70 and cavities 80 are present on the interfacing surfaces and there is typically some degree of interlocking of the same. These asperities 70 will be a mixture of the lubricating solid and the binder.

In contrast to the above prior art lubricant, when the plates 60 are moved relative to each other, including when there ia a load $F_2$, generally similar to $F_1$, applied to one or both of the plates 60, the asperities 70, due to the flexibility of the lubricant 50 provided by the chlorotrifluoroethylene-vinyl chloride polymer binder, bend versus break for an acceptable amount of time such that the wear life of the lubricant 50 is improved over the lubricant 20 of FIGS. 1*a* and 1*b* above. Once again, the principles apply not only to sliding plates, but other load-bearing applications as well (e.g., gears, bearings).

In order to further illustrate the principles of the present invention, the following examples are provided in which a comparison is made between a solid film lubricant in accordance with the present invention and a prior art lubricant. Generally, the lubricants of the present invention include the chlorotrifluorethylene-vinyl chloride copolymer binder, molybdenum disulfide, and antimony trioxide, as well as silane where specifically noted. These lubricants are identified as "Binder No. 1 Lubricants" in the various tables. The prior art solid film lubricants include molybdenum disulfide, antimony trioxide, and polyimide binder and are identified as "Binder No. 2 Lubricants" in the various tables. In some of the tables, data is provided where an overcoating of molybdenum disulfide has been applied to the solid film and such are identified by the designation "with overcoating".

EXAMPLE 1

This Example 1 provides a direct comparison between the Binder No. 1 Lubricant (present invention) and Binder No. 2 Lubricant (prior art). Generally, the test evaluated the performance of each type of lubricant in a load-bearing application, namely when used on gears. A direct comparison is made between the Binder No. 1 and No. 2 Lubricants for six (6) different gears. Each of the gears was mounted on a shaft supported by ball bearings which incorporated metal ball separators. In the case of the six gears which were tested with the Binder No. 1 Lubricant, the ball separators were lubricated with the Binder No. 1 Lubricant as well, whereas for the six gears which were tested with the Binder No. 2 Lubricant, the associated metal ball separators were lubricated with the Binder No. 2 Lubricant. The balls and races of the ball bearings were lubricated with the same lubricant in each case.

The data comparison for the Binder No. 1 and No. 2 Lubricants is provided in Table 1 below. In evaluating the data, it should be noted that the "Test Duration" category is the number of revolutions which occurred prior to a lock-up (i.e., a termination of shaft/gear rotation).

TABLE 1

| GEAR | PITCH DIA. (in.) | NO. OF TEETH | SPEED (rpm) | LOAD (lbs/in. of face width of gear | TEST DURATION (revolutions) BINDER NO. 2 LUBRICANT | TEST DURATION (revolutions) BINDER NO. 1 LUBRICANT |
|---|---|---|---|---|---|---|
| 1 | 1.14 | 110 | 90 | 20 | $14 \times 10^6$ | $131 \times 10^6$ |
| 2 | 0.375 | 36 | 276 | 20 | $43 \times 10^6$ | $401 \times 10^6$ |
| 3 | 1.25 | 120 | 276 | 5.9 | $43 \times 10^6$ | $401 \times 10^6$ |
| 4 | 0.375 | 36 | 920 | 5.9 | $143 \times 10^6$ | $1335 \times 10^6$ |
| 5 | 1.14 | 110 | 920 | 2.0 | $143 \times 10^6$ | $1335 \times 10^6$ |
| 6 | 0.375 | 36 | 2760 | 2.0 | $432 \times 10^6$ | $4032 \times 10^6$ |

EXAMPLE 2

This Example 2 provides a comparison between the Binder No. 1 and No. 2 Lubricants when undergoing a standard "pin-on-disk" testing. The superior wear life exhibited by the present invention is further quantified by the low $K_w$ (wear coefficient) shown in Table 2 below for Binder No. 1 lubricant specimens. For example, a $K_w$ of $1.81\times10^{-9}$ in$^2$/lb$_f$ is larger than a $K_w$ of $7.86\times10^{-10}$ in$^2$/lb$_f$ by factor of 2.3/1; hence, the $1.81\times10^{-9}$ in$^2$/lb$_f$ sample wears out 2.3 times faster than the latter sample. The comparative data is presented in Table 2 below.

TABLE 2

| Lubricant | Coupon Number | Average Coefficient of Friction | Duration (seconds) | Peak Coefficient of Friction | $K_w(in^2/lb_f)$ |
|---|---|---|---|---|---|
| Binder No. 2 Lubricant | A | 0.19 | $1.17 \times 10^4$ | 0.40 | $1.81 \times 10^{-9}$ |
| Binder No. 2 Lubricant with overcoating | B | 0.22 | $1.04 \times 10^4$ | 0.37 | $2.04 \times 10^{-9}$ |
| Binder No. 1 Lubricant, room temperature cure | 11 | 0.11 | $5.56 \times 10^4$ | 0.27 | $3.82 \times 10^{-10}$ |
| Binder No. 1 Lubricant, room temperature cure | 127 | 0.11 | $6.38 \times 10^4$ | 0.31 | $3.32 \times 10^{-10}$ |
| Binder No. 1 Lubricant, room temperature cure | 128 | 0.098 | $6.37 \times 10^4$ | 0.40 | $3.33 \times 10^{-10}$ |
| Binder No. 1 Lubricant, room temperature cure | 129 | 0.096 | $7.19 \times 10^4$ | 0.31 | $2.95 \times 10^{-10}$ |
| Binder No. 1 Lubricant, 1 hr. 50° C. cure | 124 | 0.13 | $4.21 \times 10^4$ | 0.28 | $5.04 \times 10^{-10}$ |
| Binder No. 1 Lubricant, 1 hr. 100° C. cure | 121 | 0.11 | $7.12 \times 10^4$ | 0.36 | $2.98 \times 10^{-10}$ |
| Binder No. 1 Lubricant + 0.5% silane, room temperature cure | 41 | 0.13 | $3.62 \times 10^4$ | 0.30 | $5.86 \times 10^{-10}$ |
| Binder No. 1 Lubricant + 0.5% silane, room temperature cure | 43 | 0.10 | $1.33 \times 10^5$ | 0.35 | $1.59 \times 10^{-10}$ |
| Binder No. 1 Lubricant + 0.5% silane, room temperature cure | 44 | 0.092 | $1.43 \times 10^5$ | 0.31 | $1.48 \times 10^{-10}$ |
| Binder No. 1 Lubricant + 0.5% silane, 1 hr. at 100° C. cure | 31 | 0.098 | $1.11 \times 10^4$ | 0.33 | $1.91 \times 10^{-10}$ |
| Binder No. 1 Lubricant + 1.0% silane, room temperature cure | 71 | 0.13 | $2.15 \times 10^4$ | 0.29 | $9.87 \times 10^{-10}$ |
| Binder No. 1 Lubricant + 1.0% silane, room temperature cure | 73 | 0.10 | $9.22 \times 10^4$ | 0.25 | $2.30 \times 10^{-10}$ |
| Binder No. 1 Lubricant + 1.0% silane, room temperature cure | 74 | 0.098 | $5.41 \times 10^4$ | 0.25 | $3.92 \times 10^{-10}$ |
| Binder No. 1 Lubricant + 1.0% silane, 1 hr. at 100° C. cure | 61 | 0.12 | $9.56 \times 10^4$ | 0.35 | $2.22 \times 10^{-10}$ |
| Binder No. 1 Lubricant + 5.0% silane, room temperature cure | 101 | 0.25 | $2.70 \times 10^4$ | 0.40 | $7.86 \times 10^{-10}$ |
| Binder No. 1 Lubricant + 5.0% silane with overcoating, room temperature cure | 102 | 0.24 | $1.10 \times 10^4$ | 0.40 | $1.93 \times 10^{-9}$ |

EXAMPLE 3

This Example 3 provides a comparison between Binder No. 1 and No. 2 Lubricants when undergoing a standard "Falex" testing procedure (ASTM D-2625, Procedure A). The comparative data is presented in Table 3 below.

TABLE 3

| | DURATION (seconds) | $K_w(in^2/lb_f)$ |
|---|---|---|
| Binder No. 2 Lubricant with overcoating | | |
| Test 1 | $3.85 \times 10^4$ | $4.17 \times 10^{-12}$ |
| Test 2 | $3.92 \times 10^4$ | $4.10 \times 10^{-12}$ |
| Test 3 | $2.23 \times 10^4$ | $7.20 \times 10^{-12}$ |
| Test 4 | shear pin malfunction prior to a failure | |
| Average | $3.33 \times 10^4$ | $5.16 \times 10^{-12}$ |
| Binder No. 2 Lubricant with overcoating | | |
| Sample No. 6 | $2.88 \times 10^4$ | $5.58 \times 10^{-12}$ |
| Sample No. 7 | $3.17 \times 10^4$ | $5.07 \times 10^{-12}$ |
| Sample No. 8 | $3.02 \times 10^4$ | $5.32 \times 10^{-12}$ |
| Average | $3.02 \times 10^4$ | $5.32 \times 10^{-12}$ |
| Binder No. 1 Lubricant with overcoating, room temperature cure | | |
| Test 1 | $1.26 \times 10^4$ | $8.11 \times 10^{-12}$ |
| Test 2 | $2.53 \times 10^4$ | $4.04 \times 10^{-12}$ |
| Test 3 | $2.28 \times 10^4$ | $4.48 \times 10^{-12}$ |
| Test 4 | $2.24 \times 10^4$ | $4.56 \times 10^{-12}$ |
| Average | $2.08 \times 10^4$ | $5.30 \times 10^{-12}$ |
| Binder No. 1 Lubricant with overcoating, room temperature cure | | |
| Test 1 | $2.22 \times 10^4$ | $4.60 \times 10^{-12}$ |
| Test 2 | $4.14 \times 10^4$ | $2.47 \times 10^{-12}$ |
| Test 3 | $1.93 \times 10^4$ | $5.30 \times 10^{-12}$ |
| Test 4 | $2.15 \times 10^4$ | $4.75 \times 10^{-12}$ |
| Average | $2.61 \times 10^4$ | $4.28 \times 10^{-12}$ |

The foregoing description of the present invention has been presented for purposes of illustration and description. Furthermore, the description is not intended to limit the invention to the form disclosed herein. Consequently, variations and modifications commensurate with the above teachings, and skill and knowledge of the relevant art, are within the scope of the present invention. The embodiments described hereinabove are further intended to explain best modes known of practicing the invention and to enable others skilled in the art to utilize the invention in such or other embodiments, and with various modifications required by the particular applications or uses of the present invention. It is intended that the appended claims be construed to include alternative embodiments to the extent permitted by the prior art.

What is claimed is:

1. A method for lubricating first and second interfaceable surfaces, comprising the steps of:

selecting a binder comprising a copolymer of vinyl chloride and chlorotrifluoroethylene;

incorporating said binder into a solid film lubricant;

applying said solid film lubricant to at least said first surface, wherein when said first and second surfaces are interfacing, said lubricant and said second surface have interlocking asperities and cavities; and moving said first surface relative to said second surface, wherein said asperities of said solid film lubricant bend to provide an acceptable wear life.

2. A method, as claimed in claim 1, wherein:

said solid film lubricant comprises a dichalcogenide.

3. A method, as claimed in claim 3, further comprising the step of:

curing said solid film lubricant.

4. A method, as claimed in claim 3, wherein:

said curing step comprises incorporating a silane in said solid film lubricant.

5. A method, as claimed in claim 3, wherein:

said curing step comprises exposing said solid film lubricant to ambient temperature.

6. A method, as claimed in claim 1, further comprising the step of:

overcoating said solid film lubricant with burnished molybdenum disulfide after said applying step.

7. A method, as claimed in claim 1, further comprising the step of:

overcoating said solid film lubricant with a perfluorinated telomer after said applying step.

8. A method of lubrication, comprising the steps of:

applying a dry solid film lubricant to a surface of a first member, said dry solid film lubricant comprising a chlorotrifluoroethylene-vinyl chloride copolymer binder and a solid, said first member being substantially rigid; and interfacing at least a portion of said surface of said first member with at least a portion of a surface of a second member, wherein said second member is substantially rigid; and communicating a load between said interfacing surfaces of said first and second members.

9. A method, as claimed in claim 8, further comprising the step of:

curing said dry solid film lubricant.

10. A method, as claimed in claim 9, wherein:

said curing step comprises incorporating a silane into said dry solid film lubricant.

11. A method, as claimed in claim 9, wherein:

said curing step comprises exposing said dry solid film lubricant to ambient temperature.

12. A method, as claimed in claim 8, further comprising the step of:

overcoating said dry solid film lubricant with burnished molybdenum disulfide after said applying step.

13. A method, as claimed in claim 8, further comprising the step of:

overcoating said dry solid film lubricant with a perfluorinated telomer after said applying step.

14. A method for lubricating first and second interfaceable surfaces, comprising the steps of:

selecting a solid film lubricant having a flexible binder when cured whereby said solid film lubricant has a wear coefficient of less than about $9.87\times10^{-10}$ in$^2$/lb, as measured by a standard pin-on-disc testing technique;

applying said solid film lubricant to at least said first surface, wherein when said first and second surfaces are interfaced, said lubricant and said second surface have interlocking asperities and cavities;

moving said first surface relative to said second surface;

bending said asperities of said solid film lubricant during said moving step;

repeating said moving and bending steps a plurality of times; and maintaining a substantial portion of said asperities of said solid film lubricant during said repeating step.

* * * * *